US006282934B1

(12) United States Patent
Bikert et al.

(10) Patent No.: US 6,282,934 B1
(45) Date of Patent: Sep. 4, 2001

(54) METHOD AND DEVICE FOR FORMING A WORKPIECE BY APPLICATION OF A HIGH INTERNAL PRESSURE

(75) Inventors: Arndt Bikert, Bretzfeld-Unterheimbach; Stefan Bobbert, Stuttgart, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/601,954

(22) PCT Filed: Jan. 20, 1999

(86) PCT No.: PCT/EP99/00340

§ 371 Date: Sep. 28, 2000

§ 102(e) Date: Sep. 28, 2000

(87) PCT Pub. No.: WO99/41028

PCT Pub. Date: Aug. 19, 1999

(30) Foreign Application Priority Data

Feb. 10, 1998 (DE) ..... 198 05 172

(51) Int. Cl.[7] ..... B21D 39/08; B21D 39/20; B21D 26/02

(52) U.S. Cl. ..... 72/58; 72/61; 72/62

(58) Field of Search ..... 72/58, 60, 61, 72/62

(56) References Cited

U.S. PATENT DOCUMENTS

| | | | | |
|---|---|---|---|---|
| 3,800,578 | | 4/1974 | Brennan et al. | 72/56 |
| 4,619,129 | | 10/1986 | Petkov et al. | 72/56 |
| 5,953,945 | * | 9/1999 | Horton | 72/58 |
| 6,014,879 | * | 1/2000 | Jackel et al. | 72/61 |
| 6,029,487 | * | 2/2000 | Genin et al. | 72/58 |
| 6,128,936 | * | 10/2000 | Yogo | 72/58 |

FOREIGN PATENT DOCUMENTS

| | | |
|---|---|---|
| 1 602 530 | 8/1970 | (DE) . |
| 94 07 812 | 9/1994 | (DE) . |
| 0 018 255 | 10/1980 | (EP) . |

* cited by examiner

*Primary Examiner*—David Jones
(74) *Attorney, Agent, or Firm*—Crowell & Moring LLP

(57) ABSTRACT

The invention relates to a process and an apparatus for the internal high-pressure forming of a workpiece in a closed internal high-pressure forming die. In the present invention, the workpiece is expanded by a fluidic internal high pressure exerted by a pressure generator and the workpiece is brought to bear against the cavity of the forming die. To improve the process reliability during the internal high-pressure forming of the workpiece, it is proposed to introduce the internal high pressure in the form of a pressure oscillation.

23 Claims, 1 Drawing Sheet

METHOD AND DEVICE FOR FORMING A WORKPIECE BY APPLICATION OF A HIGH INTERNAL PRESSURE

BACKGROUND AND SUMMARY OF THE INVENTION

The invention relates to a process for the internal high-pressure forming of a workpiece in a closed internal high-pressure forming die, the workpiece being expanded on account of the fluidic internal high pressure exerted by a pressure generator and being brought to bear against a cavity of the forming die. The invention also relates to an apparatus for carrying out the process which has an internal high-pressure forming die which is divided along the extent of the workpiece and has a pressure generator which is fluidically connected to the forming die for exerting a fluidic internal high pressure on the workpiece.

A process of the generic type and an apparatus of the generic type are known from German Patent Document DE 94 07 812.2 U1. In this case, a hollow profile forming the workpiece is placed into an internal high-pressure forming die divided along the extent of the hollow profile, after which the die is closed. The hollow profile is subsequently closed in a sealing manner at both ends by axial male dies. The space inside the hollow profile is filled by means of the axial male dies. The axial male dies are fluidically connected to a pressure generator. Then, an internal high pressure is applied within the hollow profile by means of the pressure generator, having the effect of expanding the profile until it is brought to bear against the wall of the die cavity. The die cavity has a branch which leads away radially from the extent of the hollow profile and into which the material of the hollow profile is forced by being subjected to the internal high pressure, with the effect of forming a neck. Here, too, the material is brought to bear against the wall of the branch. The expanding process within the branch is stabilized by a counterslide which is guided displaceably in the branch and supports the neck in the end region. To extend the failure limits with regard to bursting during pure expansion, in which the length of the hollow profile is shortened, and consequently to obtain a greater expanded length of the neck, further material of the hollow profile is pushed towards the branching location by an additional axial force, which is applied by moving in of the axial male dies, with the effect of at least partially compensating for the thinning of the material in the branching region responsible for bursting. Nevertheless, when the material of the hollow profile is in contact with the cavity wall, in particular also in the branch, the shaping capability of the material is limited considerably by the friction produced between the die and the hollow profile, which becomes greater with increasing internal high pressure—even if the hollow profile is provided with a lubricant on its outer side. This is very problematical most particularly in the case of materials with little propensity to undergo forming.

The invention is based on the object of developing a process and an apparatus in which process reliability in the internal high-pressure forming of workpieces is improved.

The object is achieved according to the invention with regard to the process by introducing an internal high pressure in the form of a pressure oscillation. The apparatus of the present invention achieves the object by incorporating a pressure oscillator by means of which the internal high pressure can be introduced into the workpiece as a pressure oscillation.

The fact that the internal high pressure acts on the workpiece in the form of a pressure oscillation has the effect that the friction of the workpiece on the cavity wall is reduced during the period of time between the maxima of the oscillation, since there is a region of lower pressure there. In other words, during the forming operation there is a periodically occurring partial relief of the normal stress of contact between the workpiece and the die. By reducing the friction, however, the resistance to additional material of the workpiece flowing or being fed towards the shaping location also becomes less, so that more material can be moved to this location without failure. This counteracts thinning of material in the shaping region, a more favorable distribution of material for forming being achieved and/or it being possible to increase the degree of forming. For example in the case of a branch from the cavity, i.e. when forming a neck, this may mean an increase in the expanded length. Consequently, the limits of the process can be extended, for example with regard to the production of secondary formed elements. Furthermore, on account of the increased feeding of additional material, narrower radii can also be formed on the workpiece in a reliable process, without cracking. Altogether, the invention achieves improved forming even of workpieces from materials with little propensity to undergo dimensional change. Partial isolation of the process parameters from the tribological conditions accomplishes greater process stability. For designing the process optimally with the greatest possible benefit for the respective forming, the pressure oscillation is to be adapted appropriately in its amplitude and frequency with regard to the material of the workpiece and the degree of forming of the shape to be accomplished, in other words the geometry of the fully formed workpiece or other relevant process parameters.

BRIEF DESCRIPTION OF THE DRAWINGS

Expedient configurations of the invention can be taken from the subclaims; moreover, the invention is explained in more detail below on the basis of an exemplary embodiment represented in the drawings, in which:

DETAILED DESCRIPTION OF THE DRAWINGS

Figure 1:
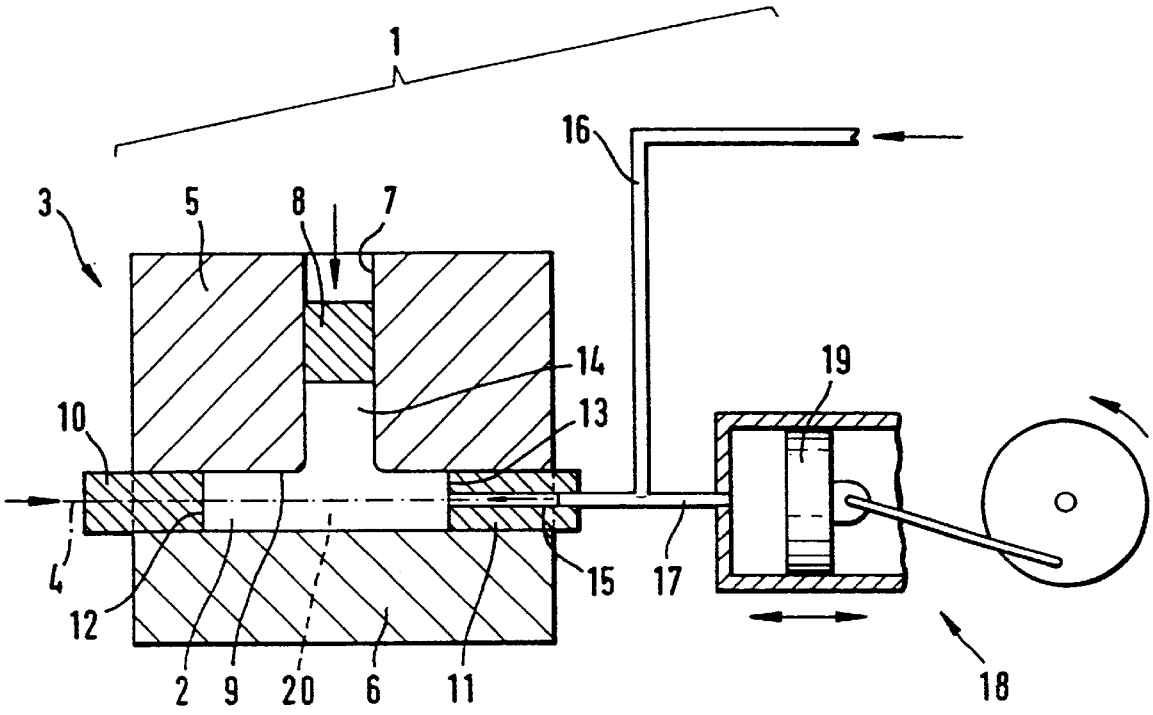
FIG. 1 shows the apparatus according to the invention schematically in a lateral longitudinal section.

Represented in FIG. 1 is an apparatus 1 for the internal high-pressure forming of a hollow-profile-shaped workpiece 2, the apparatus 1 including an internal high-pressure forming die 3, which is designed such that it is divided into two. The dividing plane 4 of the forming die 3, comprising an upper die 5 and a lower die 6, runs along the longitudinal extent of the workpiece 2. Formed in the upper die 5 is a branch 7, in which a platen 8 is displaceably guided. The tubular workpiece 2 is accommodated in a hollow space, the cavity 9, formed by the upper die 5 and the lower die 6. As can be seen from FIG. 1, the forming die 3 is in the closed position. The workpiece 2 is sealed off at both ends by axial male dies 10 and 11, both axial male dies 10 and 11 being progressively moved in during the forming, in accordance with the shortening of the tube caused by the expansion, to preserve the sealing effect. It is conceivable here for an additional axially acting force (in the direction of the arrow) to be exerted via the axial male dies 10 and 11 onto the pipe ends 12 and 13, with the effect that additional material of the hollow profile is pushed towards the expanding location, here the branch 7. The platen 8 supports in a controlled manner (in the direction of the arrow) the neck 14 being shaped in the branch 7 and consequently guards the hollow profile against rapid thinning of the material of the workpiece there, which would put the process at risk because of the chance of cracking.

Figure 2:
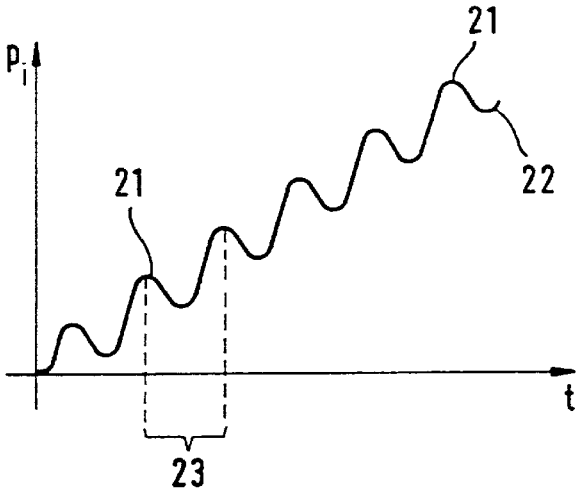
FIG. 2 shows the variation of the pressure oscillation generated by the apparatus from FIG. 1 schematically in a pressure-time diagram.

The filling of the workpiece 2 takes place via an inlet bore 15, at least in the axial male die 11. Connected to the inlet bore 15 is a delivery line 16, via which the hydraulic pressure fluid is introduced into the workpiece 2 and which leads to a pressure-fluid generating system. This includes a pressure intensifier piston, by means of which the hydraulic internal pressure is then applied (in the direction of the arrow). Upstream of the forming die 3 there opens into this delivery line 16 a separately running fluid line 17, in which a pressure oscillator 18 is arranged. This is designed as a reciprocating internal combustion engine. The piston 19 of the latter is moved back and forth during operation, with the effect that it acts on the liquid column in the fluid line 17 periodically in the form of a sine curve. The pressure oscillation generated in this way is superimposed on the delivery pressure supplied essentially continuously by means of the pressure generator. Continuously is intended here to mean that the pressure characteristic of the delivery pressure of the pressure intensifier follows a steady progression. This superimposition has the effect that the internal high pressure is likewise introduced in the form of a pressure oscillation into the hollow space 20 of the workpiece 2, which is expanded and brought to bear against the cavity 9 of the forming die 3. As FIG. 2 schematically reveals, as a result of the process the internal high pressure pi is then increased over the forming period t in the form of an oscillation. Regions 23 of reduced pressure are obtained here between the maxima 21 of the pressure curve 22, so that in these time intervals the friction of the hollow profile undergoing forming against the cavity 9 is reduced. On account of the reduced friction, the material of the workpiece can flow with less resistance, so that it is better able to undergo shaping while the process reliability is ensured. Folding cannot occur on account of the relatively short period of time of reduced high pressure. The pressure oscillation is of low frequency and may preferably have a frequency in the range of $0<\nu\leqq 50$ Hz, which particularly favours forming. However, higher frequencies of up to several hundred or thousand Hertz are also possible. In an advantageous way, the assembly of the apparatus for generating the oscillating internal high pressure is consequently provided by separate system components known per se which can be obtained at low cost, simply requiring a fluid line 17 to be connected to the customary delivery line 16 and a reciprocating internal combustion engine to be integrated into the said fluid line, involving little expenditure.

Instead of the separately arranged reciprocating internal combustion engine, it is conceivable to use the pressure generator itself as the pressure oscillator 18, the pressure intensifier piston being driven in an oscillating manner in a way corresponding to the piston 19 of the reciprocating internal combustion engine. In this case, it is possible in a structurally simplified way to dispense with the separate fluid line 17, in which case there is no superimposition of two pressure characteristics, since the pressure generator applies the internal pressure in an oscillating form.

Alternatively, it is likewise conceivable for the pressure oscillator 18 to be integrated into the fluid delivery line 16 between the pressure generator and the workpiece 2, without having the fluid line 17. In each of the cases in which the pressure intensifer does not contribute to the generation of the oscillations, the pressure oscillator 18 may also be designed as a driven unbalance mass, for example an agitating element, or as a piezo element and as an actuator. The two last-mentioned configurations are of a small construction and have, in an advantageous way, the possibility of generating oscillations in a way which can be tuned very finely and responds quickly to deliberate changes.

Finally, it should be noted that the workpiece 2 is not restricted to the design of a hollow profile, but may equally well be formed by two sheet bars lying one on top of the other.

What is claimed is:

1. Process for the internal high-pressure forming of a workpiece in a closed internal high-pressure forming die, the workpiece being expanded on account of the fluidic internal high pressure exerted by a pressure generator and being brought to bear against a cavity of the forming die, wherein the internal high pressure is introduced in the form of a pressure oscillation.

2. Process according to claim 1, wherein the pressure oscillation is generated by the pressure generator itself.

3. Process according to claim 1, wherein a pressure oscillation is superimposed on the continuous delivery pressure produced by the pressure generator.

4. Process according to claim 3, wherein the pressure oscillation is generated by means of an oscillator integrated into the delivery line of the pressure generator towards the workpiece.

5. Process according to claim 3, wherein the pressure oscillation is generated by means of an oscillator arranged in a fluid line which is separate from the delivery line of the pressure generator, running towards the workpiece, and opens into the delivery line upstream of the forming die.

6. Process according to claim 1, wherein the pressure oscillation has a frequency in the range of 0<n£50 Hz.

7. Apparatus for an internal high-pressure forming of a workpiece, having an internal high-pressure forming die which is divided along the extent of the workpiece and having a pressure generator which is fluidically connected to the forming die and intended for exerting a fluidic internal high pressure on the workpiece, wherein the apparatus includes a pressure oscillator, by means of which the internal high pressure can be introduced into the workpiece as a pressure oscillation.

8. Apparatus according to claim 7, wherein the pressure generator forms the pressure oscillator, the pressure generator including a pressure intensifier piston which is driven in an oscillating manner.

9. Apparatus according to claim 7, wherein the pressure oscillator is integrated into the fluid delivery line between the pressure generator and the workpiece.

10. Apparatus according to claim 7, wherein a fluid line in which the pressure oscillator is arranged opens into the fluid delivery line.

11. Apparatus according to claim 10, wherein the pressure oscillator is a reciprocating internal combustion engine.

12. Apparatus according to claim 9, wherein the pressure oscillator is a piezo element.

13. A process for forming a workpiece in a closed internal high-pressure forming die comprising:

providing a tubular workpiece in a cavity of the forming die;

generating a high pressure fluid with a pressure generator;

providing a pressure oscillation to the high pressure fluid;

supplying the high pressure fluid having the pressure oscillation to the cavity; and expanding the workpiece against the cavity of the forming die by the high pressure fluid having the pressure oscillation.

14. The process of claim 13, wherein the pressure generator generates the high pressure fluid and provides the pressure oscillation to the high pressure fluid.

15. The process of claim 13, wherein providing the pressure oscillation to the high-pressure fluid is performed by superimposing a separately formed pressure oscillation on the high pressure fluid generated by the pressure generator.

16. The process of claim 15, wherein a pressure oscillator generates the separately formed pressure oscillation, the pressure oscillator being integrated into a delivery line of the high pressure fluid.

17. The process of claim 13, wherein the pressure oscillation has a frequency in the range of the $0<n\leqq 50$ Hz.

18. An apparatus for forming a workpiece by internal high-pressure comprising:

an internal high-pressure forming die including a cavity for a tubular workpiece;

a pressure generator fluidically connected to the cavity of the forming die by a delivery line for supplying a high pressure fluid to an interior of the tubular workpiece;

and a pressure oscillator fluidically connected to the high-pressure fluid generated by the pressure generator and operable to impart a pressure oscillation to the high-pressure fluid.

19. The apparatus of claim 18, wherein the pressure oscillator is incorporated in the pressure generator and the pressure oscillator includes a pressure intensifier piston with a drive for oscillating the piston and imparting the pressure oscillation to the high pressure fluid.

20. The apparatus of claim 18, wherein the pressure oscillator is integrated into the delivery line between the pressure generator and the cavity of the forming die.

21. The apparatus of claim 18, wherein a fluid line of the pressure oscillator opens into the delivery line supplying the high pressure fluid to the tubular workpiece.

22. The apparatus of claim 21, wherein the pressure oscillator is a reciprocating internal combustion engine.

23. The apparatus of claim 20, wherein the pressure oscillator is a piezo element.

* * * * *